US009178301B2

(12) United States Patent
Shiga

(10) Patent No.: US 9,178,301 B2
(45) Date of Patent: Nov. 3, 2015

(54) WATERPROOF CONNECTOR AND WIRE SEAL

(71) Applicant: Tyco Electronics Japan G.K., Kanagawa-ken (JP)

(72) Inventor: Katsumi Shiga, Chiba (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 176 days.

(21) Appl. No.: 13/937,620

(22) Filed: Jul. 9, 2013

(65) Prior Publication Data

US 2014/0011400 A1 Jan. 9, 2014

(30) Foreign Application Priority Data

Jul. 9, 2012 (JP) ..... 2012-153780

(51) Int. Cl.
*H01R 13/40* (2006.01)
*H01R 13/52* (2006.01)

(52) U.S. Cl.
CPC ..... *H01R 13/5205* (2013.01); *H01R 13/5208* (2013.01)

(58) Field of Classification Search
CPC . H01R 13/5205; H01R 13/5208; H01R 13/52
USPC ..... 439/587, 589, 588, 274, 275, 279
See application file for complete search history.

(56) References Cited

U.S. PATENT DOCUMENTS 7,114,991 B2 10/2006 Shiga et al.
8,608,508 B2 * 12/2013 Kataoka ..... 439/587

FOREIGN PATENT DOCUMENTS

JP 2010-140876 6/2010

* cited by examiner

*Primary Examiner* — Javaid Nasri
(74) *Attorney, Agent, or Firm* — Barley Snyder

(57) ABSTRACT

A wire seal for a waterproof connector having a seal body with a mating end surface and a terminal end surface, a plurality of wire insertion passageways extending through the seal body from the mating end surface to the terminal end surface, inner seal projections disposed on an inner peripheral wall of each of the wire insertion passageways, and relief grooves disposed on the mating end surface and the terminal end surface between adjacent wire insertion passageways.

14 Claims, 7 Drawing Sheets

FIG. 4C
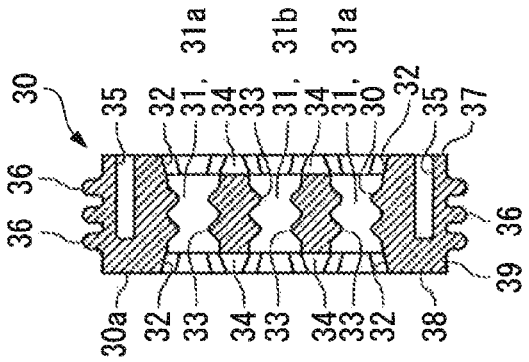
FIG. 4A
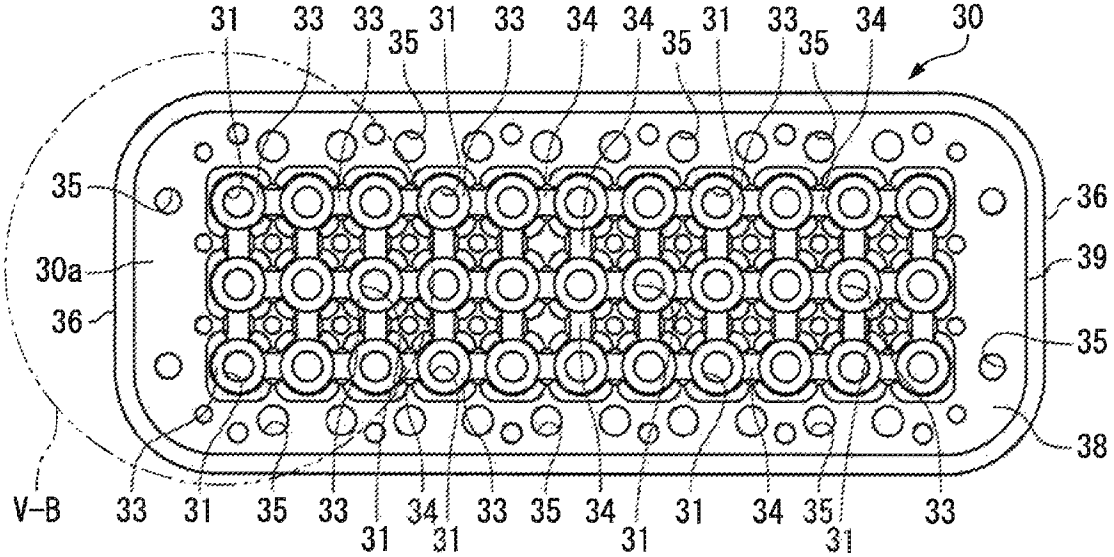
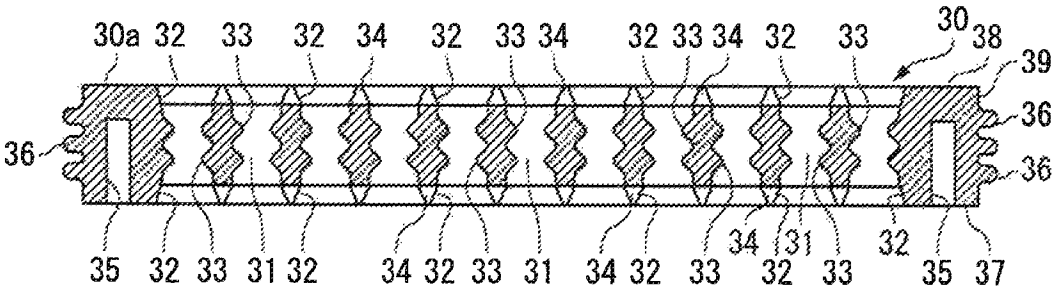
FIG. 4B

WATERPROOF CONNECTOR AND WIRE SEAL

CROSS-REFERENCE TO RELATED APPLICATIONS

This application claims the benefit of the filing date under 35 U.S.C. §119(a)-(d) of Japanese Patent Application No. 2012-153780, filed Jul. 9, 2012.

FIELD OF THE INVENTION

The present invention relates to a wire seal mounted in a waterproof electrical connector (hereinafter, referred to as a "connector").

BACKGROUND

Waterproof connectors often use a wire seal or seal member, known as a family seal, disposed in a connector housing to prevent water and the like from penetrating from the outside. This wire seal comprises a plurality of wire insertion passageways at positions corresponding to a plurality of contacts (terminal fittings) held by the connector housing. When the contact is inserted into a cavity for holding the contact through the wire insertion passageway, an electric wire connected to the contact comes into tight contact with a seal projection provided around the wire insertion passageway, thereby ensuring the waterproofness of the connector.

However, in cases involving a waterproof connector having a wire seal with plurality of wire insertion passageways of the same specifications, contacts having electric wires with different wire diameters are often inserted. When a thick electric wire is inserted into the wire insertion passageway, the compressed seal material has no escape space in the surroundings of the wire insertion passageway, so the seal material runs off into the adjacent wire insertion passageway. In this case, if an attempt is made to insert a thick electric wire into the adjacent wire insertion passageway, the running-off seal material becomes a resistance, and the burden of contact-mounting work increases. If an attempt is made to insert the thick electric wire forcibly, a rubber break occurs in the seal material (seal projection). In this case, the desired waterproofing performance cannot be achieved.

To combat the above-described problems, some proposals have been made (for example, Japanese Patent Publication No. 2005-317385 and Japanese Patent Publication No. 2010-140876).

Japanese Patent Publication No. 2005-317385 proposes a technique in which relief grooves depressed in the thickness direction of a seal member are formed at positions adjacent to the wire insertion passageways near the outer edge of wire seal. However, since the relief grooves are provided near the outer edge of the wire seal, although the seal material located on the outer periphery side of the wire seal can run off into the relief grooves, the seal material located at positions distant from the outer periphery side cannot run off into the relief grooves.

Japanese Patent Publication No. 2010-140876 proposes a technique in which one side in the axial direction of the wire insertion passageway provided in the wire seal is made a large-diameter section, and the other side thereof is made a small-diameter section, and the adjacent wire insertion passageways are arranged so that the orientations of the large-diameter section and the small-diameter section are different between the front surface and the back surface of the seal member. However, where the small-diameter section of the wire insertion passageway is arranged on the contact insertion side, the contact abuts with the seal material around the small-diameter section, so that contact insertion requires greater insertion force, and, a rubber break may occur if an attempt is made to insert the contact forcibly.

Accordingly, an object of the invention, among other objects is to provide a wire seal into which even an electric wire having a large wire diameter can be inserted without difficulty, and without depending on the position at which a wire insertion passageway is arranged.

Also, another object of the invention is to provide a waterproof connector comprising the above-described wire seal to achieve the desired waterproofing performance.

SUMMARY

A wire seal for a waterproof connector having a seal body with a mating end surface and a terminal end surface, a plurality of wire insertion passageways extending through the seal body from the mating end surface to the terminal end surface, inner seal projections disposed on an inner peripheral wall of each of the wire insertion passageways, and relief grooves disposed on the mating end surface and the terminal end surface between adjacent wire insertion passageways.

BRIEF DESCRIPTION OF THE DRAWINGS

FIG. 4A is a plan view of a wire seal;

FIG. 4B is a longitudinal sectional view of the wire seal;

FIG. 4C is a transverse sectional view of the wire seal;

DETAILED DESCRIPTION

The invention will now be described in greater detail based on the embodiments shown in the accompanying drawings.

Figure 1:
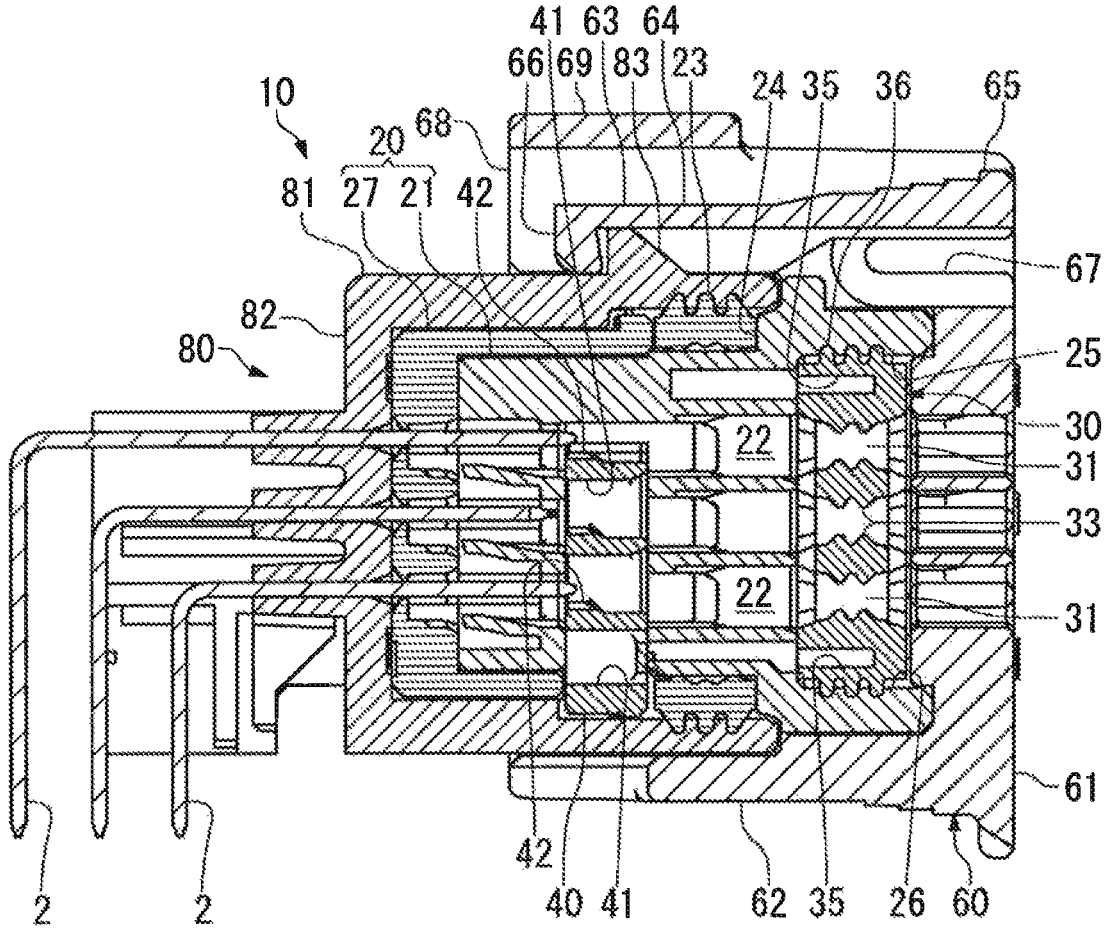
FIG. 1 is a longitudinal sectional view of a waterproof connector in accordance with an embodiment of the present invention.
Figure 2A:
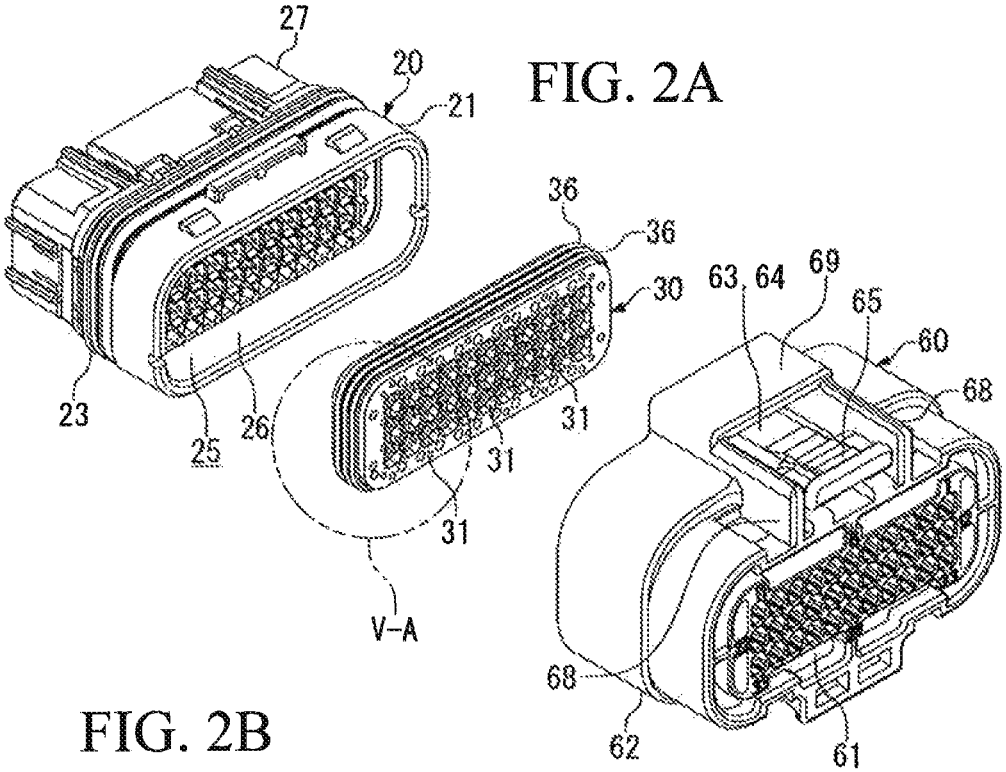
FIG. 2A is an exploded perspective view of a female connector.
Figure 2B:
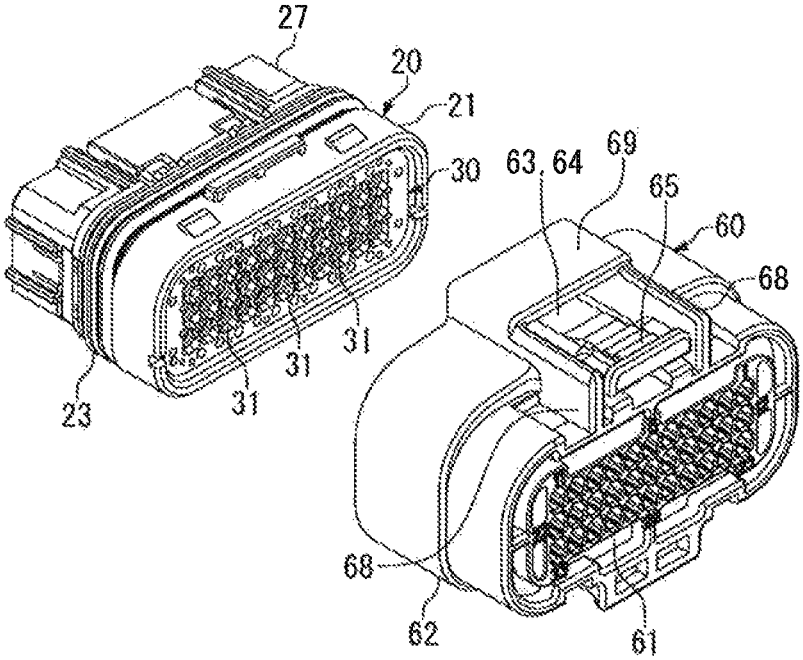
FIG. 2B is an exploded perspective view of the female connector in the state in which a wire seal is assembled to an inner housing.
Figure 3:
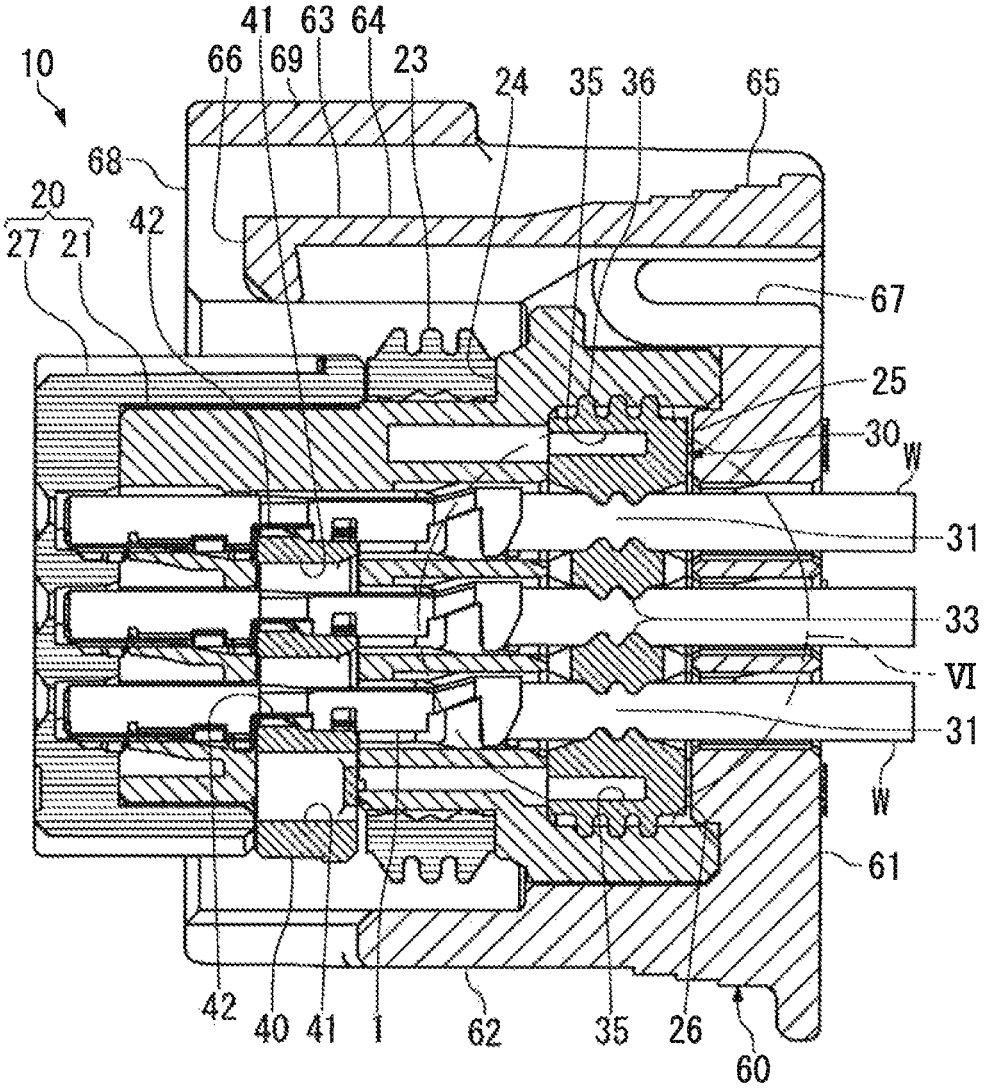
FIG. 3 is a longitudinal sectional view of a female connector.
Figure 5A:
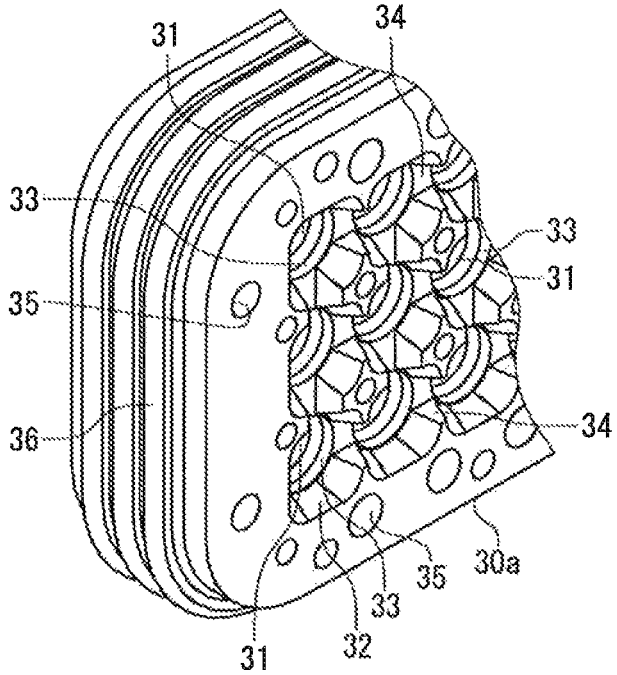
FIG. 5A is an expanded view of the V-A portion of the wire seal shown in FIG. 2A.
Figure 5B:
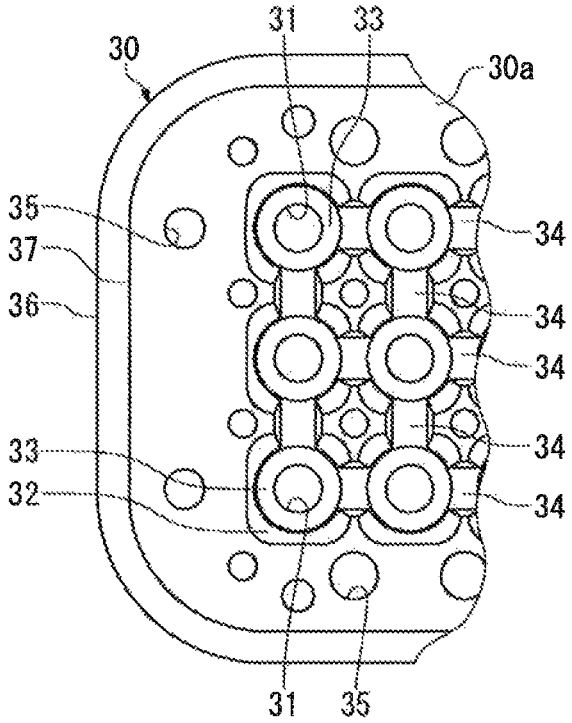
FIG. 5B is an expanded view of the V-B portion of the wire seal shown in FIG. 4A.

As shown in FIGS. 1 to 3, a waterproof connector 10 includes an inner housing 20 holding a plurality of female contacts 1 (FIG. 3), a retainer 40, and an outer housing 60 accommodating the inner housing 20 and the retainer 40. When the waterproof connector 10 is engaged with a mating connector 80, the contacts 1 are electrically engaged with a plurality of male contacts 2 held by the mating connector 80. For the waterproof connector 10, water is prevented from penetrating thereinto by providing a seal member 23 between the waterproof connector 10 and the mating connector 80 and also providing a wire seal 30 in the inner housing 20. In the description below, explanation is given by defining the side on which the waterproof connector 10 and the mating connector 80 are engaged with each other as the mating end, by defining the side on which electric wires W extend out of the waterproof connector 10 as the terminal end, and by defining the side on which the male contacts 2 extend out of the mating connector 80 as the contact end.

The inner housing 20 includes an inner body 21 formed with a plurality of contact insertion passageways 22 into which the contacts 1 are inserted, and an inner member 27 provided on the mating end of the inner body 21. The inner body 21 and the inner member 27 each are manufactured as a unit by injection-molding an insulating resin. The outer housing 60 and a mating housing 81 of the mating connector 80 are also manufactured by injection-molding an insulating resin.

On an outer peripheral surface of the inner body 21, the ring-shaped seal member 23 is disposed. The seal member 23 is positioned by being butted against a step 24 formed in the outer peripheral surface of the inner body 21. This seal member 23 may be made of silicone rubber, nitrile rubber, fluororubber, or any other material suitable to provide a seal. The seal member 23 plays a role in waterproofing between the inner housing 20 and the mating housing 81.

A seal accommodating recess 25 is provided at the terminal end of the inner body 21. The wire seal 30 is disposed in the seal accommodating recess 25. The wire seal 30 stops water collectively at the outer periphery of the electric wires W connected to the contacts 1. The wire seal 30 prevents water, which comes along the electric wires W, from penetrating into the inner housing 20. The wire seal 30, which is a feature of this embodiment, will be explained in detail later.

The inner member 27, together with the inner body 21, holds the contacts 1.

When the inner member 27 is assembled to the inner body 21, the seal member 23 is positioned on the outer peripheral surface of the mating end of the inner body 21, adjacent to the terminal end of the inner member 27.

The retainer 40 secondarily locks the contacts 1 inserted in the contact insertion passageways 22. The retainer 40 comprises a plurality of rows of openings 41 so as to correspond to the contact insertion passageways 22. The contacts 1 inserted in the contact insertion passageways 22 are inserted into the openings 41. On the lower side of each of the openings 41, a secondary locking member 42 for secondarily locking the contact 1 is provided. When the retainer 40 is at a temporary locking position, the contacts can pass through the openings 41 and can be inserted in the contact insertion passageways 22. When the contacts 1 have been inserted, the retainer 40 is moved to a regular locking position shown in FIGS. 1 and 3, so that the contacts 1 are secondarily locked by the secondary locking members 42.

The outer housing 60 includes a wire insertion member 61 disposed on a terminal end, through which a plurality of wire insertion passageways are formed, and a cylindrical hood 62 extending from the terminal end towards the mating end and surrounding the wire insertion member 61.

The hood 62 is integrally provided with a latching mechanism engageable with a catch 83 disposed on an outer peripheral surface of the mating housing 81. The latching mechanism comprises a latch arm 63 having an arm body 64, a latching projection 66 extending towards the outer housing 60, a flexible hinge 67, and a releasing member 65. The latching projection 66 is located on a mating end of the latch arm 63 and the releasing member 65 is located on a mating end of the latch arm 63. The flexible hinge 67 is located approximately midway along the latch arm 63 and is a substantially U-shaped spring supporting the terminal end of the arm body 64. During mating of the mating connector 80 with the water proof connector 10, the latch arms 63 are deflected slightly away from the outer housing 60 as the latching projection 66 rides over the surface of the catch 83 disposed on the mating housing 81 of the mating connector 80. To disengage the latching mechanism with the catch 83, the releasing member 65 is depressed towards the outer surface of the outer housing 60, such that the mating end of the arm body 64 is displaced away from the outer surface of the mating housing 81 and the latching projection 66 is disengaged from the catch 83.

A pair of protective walls 68 extend along a terminal end to mating end direction and protrude from the outer surface of the wire insertion member 61 and the hood 62. The latch arm 63 is flanked by the pair of protective walls 68 and is arranged in a space between the pair of protective walls 68. A roof 69 is disposed along a mating end and on a top edge of the pair of protective walls 68 to form a bridge spanning the space between the protective walls 68. The roof 69 covers a portion of the mating end of the latch arm 63 including the latching projection 66. By providing the protective walls 68 and the roof 69 in this manner, the electric wire and other objects are made less liable to come into contact with the latch arm 63, so that the latch arm 63 is protected from deformation and breakage.

The mating housing 81 receives the male contacts 2, and is engageable with the outer peripheral surface of the inner housing 20 via the seal member 23.

A first end of the contact 2 passes through contact receiving passageways in a holding wall 82 of the mating housing 81, and is inserted into the inner housing 20. An opposing second end side of the contact 2 extends out of the holding wall 82 of the mating housing 81.

To engage the mating connector 80 with the waterproof connector 10 having a configuration explained above, the mating housing 81 is inserted between the hood 62 of the outer housing 60 and the inner housing 20. The seal member 23 engages the mating housing 81, and is compressed between the mating housing 81 and the inner housing 20 to form a tight seal.

As the mating connector 80 engages with the waterproof connector 10, the latching projection 66 of the latch arm 63 is pushed up by the catch 83 of the mating housing 81, and the hinge 67 deflects. When the latching projection 66 rides over the surface of the catch 83, the deflection of the hinge 67 is restored, and the latching projection 66 and the catch 83 are engaged. Thereby, the mating connector 80 is prevented from separating from the waterproof connector 10.

To release the engagement of the mating connector 80 with the waterproof connector 10, the releasing member 65 is depressed towards the outer surface of the outer housing 60, such that the mating end of the arm body 64 is displaced away from the outer surface of the mating housing 81 and the latching projection 66 is disengaged from the catch 83. Thereby, the hinge 67 is deflected, and the latching projection 66 moves away from the catch 83. Therefore, the engagements between both of the connectors 10 and 80 can be released by separating the connectors 10 and 80 from each other in the mating side-and-terminal side direction. Next, the wire seal 30 is explained in detail with reference to FIGS. 4A to 6.

In one embodiment, the wire seal 30 is substantially rectangular, although one of ordinary skill in the art would understand that in other embodiments other shapes could also be used. The wire seal 30 is manufactured so that the shape and size of the outer periphery are such that the wire seal 30 is in tight contact with an inner peripheral surface 26 of the seal accommodating recess 25. The wire seal 30 comprises a plurality of seal projections 36 for improving the tightly contacting property with the inner peripheral surface 26. In one embodiment, at least two seal projections 36 are provided. In another embodiment, at least three seal projections are provided. In yet another embodiment, at least four seal projections 36 are provided. The seal projections 36 are formed along an outer peripheral edge 39 of a seal body 30*a*. For the seal projection 36, the undeformed original shape is shown in the figures so that the shape of the seal projection 36 is understandable. The same is true for an inner seal projection 33, described later, and the seal member 23, described above.

In the wire seal 30, a plurality of wire insertion passageways 31 are formed at the positions corresponding to the contact insertion passageways 22 so as to penetrate through between a mating end surface 37 and a terminal end surface 38 forming the mating side and terminal side surfaces of the seal body 30*a*. The electric wire W connected to the contact 1 in the contact insertion passageway 22 passes through the wire insertion passageway 31 and the wire insertion member 61 of the outer housing 60, and is introduced into the inner housing 20.

In the wire insertion passageway 31, a recessed guiding member 32 is formed to a predetermined depth on both surface sides of the mating end surface 37 and the terminal end surface 38 of the seal body 30*a*. The guiding member 32 is formed so that the opening diameter on the mating end surface 37 increases from the center in the thickness direction of the wire seal 30 toward the mating end surface 37 and the terminal end surface 38, and guides the contact 1 to be inserted into the wire insertion passageway 31. The guiding member 32 is formed on both the mating side and terminal side of the mating end surface 37 and the terminal end surface 38 so that the wire seal 30 can be used without distinguishing the mating end surface 37 and terminal end surface 38.

Along an inner peripheral wall of the wire insertion passageway 31, a plurality of inner seal projections 33 are disposed. In one embodiment, at least two inner seal projections 33 are disposed. In another embodiment, at least three inner seal projections 33 are disposed. In yet another embodiment, at least four inner seal projections 33 are disposed. By bringing these inner seal projections 33 into tight contact with the outer peripheral surface of the electric wire W, water can be inhibited from penetrating into the inner housing 20 through the wire insertion passageway 31. The inner seal projections 33 are positioned in a substantially central portion between the guiding members 32 on both the mating end surface 37 and the terminal end surface 38 sides of the wire seal 30. Therefore, the guiding member 32 has a depth slightly smaller than the depth from the main surface 37, 38 to the inner seal projection 33.

The seal body 30*a* is formed with first relief grooves 34 located on the mating end surface 37 and the terminal end surface 38. The first relief groove 34 functions as a space into which a seal material around the inner seal projection 33 deforms and runs off when the electric wire W is inserted into the wire insertion passageway 31. The seal material in this description means a raw material forming the seal body 30*a*, with nonlimiting examples including silicone rubber, nitrile rubber, fluoro-rubber, or any other material suitable to provide a seal.

In one embodiment, the first relief grooves 34 are provided in all portions between the adjacent wire insertion passageways 31. However, in other embodiment, if the wire insertion passageway 31 into which the electric wire W having a large diameter is inserted is identified in advance, the first relief grooves 34 can be provided between the identified wire insertion passageway 31 and the adjacent wire insertion passageways 31 surrounding that wire insertion passageway 31.

In an embodiment, a guiding portion comprising the guiding members 32 and the first relief grooves 34 are present on the mating end surface 37 and the terminal end surface 38. This guiding portion is positioned such that the individual wire insertion passageways 31 are prevented from deforming the adjacent wire insertion passageway 31 when a thick electric wire W is inserted.

In an embodiment, the first relief groove 34 is formed on both the mating end surface 37 and the terminal end surface 38 of the seal body 30*a*, adjacent to the recessed guiding member. In another embodiment, the depth of the first relief groove 34 is equal to the depth of the adjacent guiding members 32. However, in other embodiments the depth of the first relief groove 34 is not limited to the depth of the adjacent guiding members 32. In further embodiments, the depth of the first relief groove 34 may be less than the depth of the guiding member 32. However, a phenomenon that the inner seal projection 33 easily runs off in the planar direction of the wire seal 30 is unfavorable in obtaining tight contact of the inner seal projection 33 with the electric wire W. In another embodiment, a first relief groove 34 is not provided.

In another embodiment, the first relief grooves 34 are provided in all portions between the adjacent wire insertion passageways 31, and the plurality of first relief grooves 34 are arranged in the lengthwise direction and the width direction of the wire seal 30. In yet another embodiment, the first relief grooves 34 can also be provided between the wire insertion passageways 31 so that the plurality of first relief grooves 34 are arranged so as to be inclined with respect to the lengthwise or width direction. In another embodiment, the plurality of first relief grooves 34 can also be provided so as to be arranged along only either one of the lengthwise direction and the width direction.

In an embodiment, the seal body 30*a* comprises a plurality of second relief grooves 35 that are open to the mating end surface 37 between the outer peripheral edge 39 of the seal body 30*a* and the wire insertion passageways 31 positioned proximate to the outer peripheral edge 39. The second relief groove 35 serves as a space into which the seal material runs off when the electric wire W is inserted into the wire insertion passageway 31 positioned proximate to the outer periphery edge 39 of the wire seal body 30*a*. The second relief groove 35 is located in the middle of the adjacent two wire insertion passageways 31, and therefore the two wire insertion passageways 31 are present at positions symmetrical with respect to the second relief groove 35.

Figure 6:
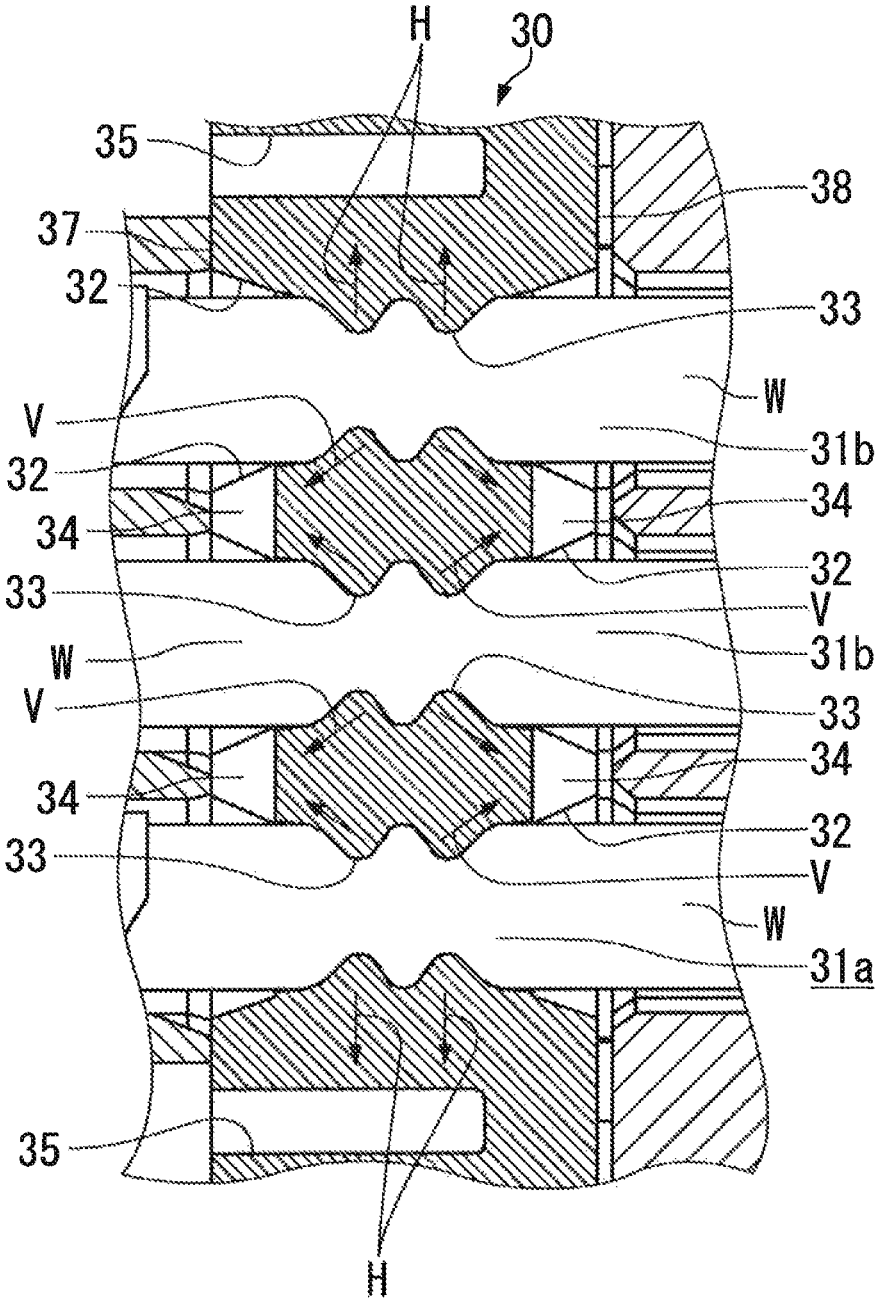
FIG. 6 is an expanded view of the VI portion of a wire seal shown in FIG. 3.

In inserting the contacts 1 to which the electric wires W are connected into the waterproof connector 10, when each of the electric wires W is inserted into each of the wire insertion passageways 31 of the wire seal 30 as shown in FIG. 6, the electric wire W pushes the inner seal projections 33 in the planar direction of the wire seal 30. At this time, in the wire insertion passageway 31*a* on the outer periphery side, on the side of the peripheral edge 39 of the wire seal 30, the seal material present between the wire insertion passageway 31*a* and the second relief groove 35 can move toward the second relief groove 35 as indicated by arrow marks H in FIG. 6.

Also, on the side of the center in the planar direction of the wire seal 30, since the electric wire W is also inserted into the adjacent wire insertion passageway 31*b*, the deformation and movement of the seal material in the planar direction are restrained. However, since the first relief grooves 34 are provided around the wire insertion passageway 31*a* and the wire insertion passageway 31*b*, the seal material can move toward the first relief grooves 34 as indicated by arrow marks V in FIG. 6, towards the mating end surface 37 and the terminal end surface 38 of the wire seal 30. As described above, by providing the second relief grooves 35 in addition to the first relief grooves 34, even if thick electric wires W are inserted into the wire insertion passageway 31*a* on the outside and the wire insertion passageway 31*b* on the inside, the escape space for the seal material including the inner seal projections 33 is ensured, so that a rubber break can be prevented from occurring on the inner seal projections 33.

Figure 7:
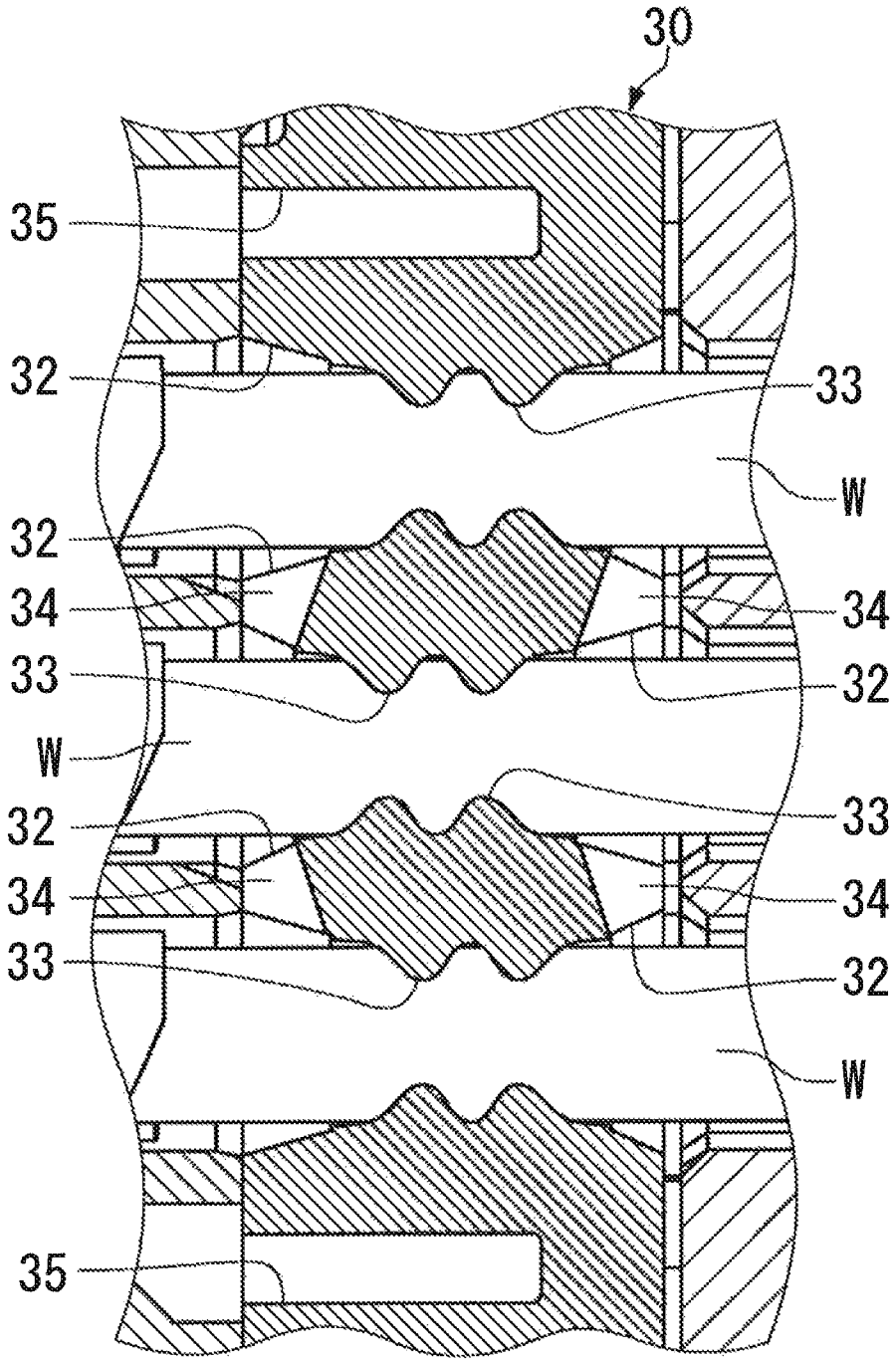
FIG. 7 is an expanded view showing the portion corresponding to FIG. 6, showing a modification example of a wire seal.

In the waterproof connector 10 embodiment explained above and seen in FIG. 6, the positions of all of the inner seal projections 33 disposed in the wire insertion passageways 31 (31*a*, 31*b*) can coincide with each other and be disposed to form a common plane along the length of the wire seal 30. However, the present invention is not limited to this configuration. In another embodiment, as shown in FIG. 7, the position of the inner seal projections 33 can be at different from each other along the wire insertion pathway. By doing this, the insertion force applied to the inner seal projections 33 facing the adjacent wire insertion passageway 31*a* can be shifted, so that the seal material including the inner seal projections 33 is deformed easily. Additionally, the force applied by electric wire W contacting the inner seal projections 33 does not concentrate at a specific position along the wire insertion passageways 31, or between the adjacent wire insertion passageways 31, allowing the contact 1 and the electric wire W to be inserted be inserted with relative ease.

One of ordinary skill in the art will appreciate that the embodiments described above are merely exemplary and that the exemplary embodiments can be selected, or changed as appropriate to any other configuration without departing from the spirit and scope of the present invention.

In one embodiment, the first relief grooves 34 are provided in all portions between the adjacent wire insertion passageways 31, and the plurality of first relief grooves 34 are arranged in the lengthwise direction and the width direction of the wire seal 30. In another embodiment, the first relief grooves 34 can also be provided between the wire insertion passageways 31 so that the plurality of first relief grooves 34 are arranged so as to be inclined with respect to the lengthwise or width direction. In yet another embodiment, the plurality of first relief grooves 34 can also be provided so as to be arranged along only either one of the lengthwise direction and the width direction.

What is claimed is:

1. A wire seal for a waterproof connector, comprising:

a seal body having a mating end surface and a terminal end surface;

a plurality of wire insertion passageways extending through the seal body from the mating end surface to the terminal end surface;

inner seal projections disposed on an inner peripheral wall of each of the wire insertion passageways; and relief grooves disposed on the mating end surface and the terminal end surface between adjacent wire insertion passageways.

2. The wire seal for a waterproof connector according to claim 1, wherein the inner seal projections in adjacent wire insertion passageways are disposed to form a common plane along the length of the seal body.

3. The wire seal for a waterproof connector according to claim 1, wherein the inner seal projections in adjacent wire insertion passageways are disposed at different positions along the wire insertion passageway.

4. The wire seal for a waterproof connector according to claim 1, wherein a depth of the relief grooves on the mating end surface is less than a depth of the inner seal projections disposed on the inner peripheral wall of the wire insertion passageway.

5. The wire seal according to claim 1, wherein a depth of the relief grooves from the terminal end surface is less than a depth of the inner seal projections disposed on the inner peripheral wall of the wire insertion passageway.

6. The wire seal according to claim 1, wherein the wire insertion passageway comprises a recessed guiding member with an opening diameter which increases toward the mating end surface; and a depth of the relief grooves from the mating end surface is equal to a depth of the guiding members from the mating end surface.

7. The wire seal according to claim 1, wherein the wire insertion passageway comprises a recessed guiding member with an opening diameter which increases toward the terminal end surface; and a depth of the relief grooves from the terminal end surface is equal to a depth of the guiding members from the terminal end surface.

8. A waterproof connector comprising:

a contact receiving housing; and a wire seal received in the housing and having a seal body with a mating surface and a terminal surface; a plurality of wire insertion passageways; seal projections disposed on an inner peripheral wall of each of the wire insertion passageways; and relief grooves disposed on the mating end surface and the terminal end surface between adjacent wire insertion passageways.

9. The waterproof connector according to claim 8, wherein the seal projections in adjacent wire insertion passageways are disposed to form a common plane along a length of the seal body.

10. The waterproof connector according to claim 8, wherein the seal projections in adjacent wire insertion passageways are disposed at different positions along the wire insertion passageway.

11. The waterproof connector according to claim 8, wherein a depth of the relief grooves on the mating end surface is less than a depth of the seal projections disposed on the inner peripheral wall of the wire insertion passageway.

12. The waterproof connector according to claim 8, wherein a depth of the relief grooves from the terminal end surface is less than a depth of the seal projections disposed on the inner peripheral wall of the wire insertion passageway.

13. The waterproof connector according to claim 8, wherein the wire insertion passageway comprises a recessed guiding member with an opening diameter which increases toward the mating end surface; and a depth of the relief grooves from the mating end surface is equal to a depth of the guiding members from the mating end surface.

14. The waterproof connector according to claim 8, wherein the wire insertion passageway comprises a recessed guiding member with an opening diameter which increases toward the terminal end surface; and a depth of the relief grooves from the terminal end surface is equal to a depth of the guiding members from the terminal end surface.

* * * * *